United States Patent [19]

Gembus

[11] Patent Number: 4,593,201

[45] Date of Patent: Jun. 3, 1986

[54] CLOSURE ARRANGEMENT FOR CLOSING A WALL OPENING IN A NUCLEAR FACILITY

[75] Inventor: Hans-Dieter Gembus, Pattensen, Fed. Rep. of Germany

[73] Assignee: Deutsche Gesellschaft für Wiederaufarbeitung von Kernbrennstoffen mbH, Hanover, Fed. Rep. of Germany

[21] Appl. No.: 541,147

[22] Filed: Oct. 12, 1983

[30] Foreign Application Priority Data

Oct. 14, 1982 [DE] Fed. Rep. of Germany ..... 3238085

[51] Int. Cl.[4] ..... G21F 3/04

[52] U.S. Cl. ..... 250/517.1; 376/287

[58] Field of Search ..... 250/506.1, 515.1, 517.1; 376/272, 287; 49/404, 425

[56] References Cited

U.S. PATENT DOCUMENTS 3,200,043 8/1965 Franco et al. ..... 376/272

3,785,925 1/1974 Jones ..... 376/287

3,972,420 8/1976 Stock et al. ..... 376/272

*Primary Examiner*—Bruce C. Anderson

*Attorney, Agent, or Firm*—Walter Ottesen

[57] ABSTRACT

The invention relates to a radiation-shielding closure arrangement wherein a closure body closes off an opening in a wall between two mutually adjacent large-area cells of a nuclear facility. When the closure body is in the closed position, the cell adjacent the cell wherein radiation is present is shielded against the radiation. If one of the cells contains a cell crane and is at the same time a prohibited area because of radiation present therein, the adjacent cell is configured to be an access cell so that maintenance work on the cell crane can be conducted there. The opening in the partition wall between the two cells must be closed during the time that the maintenance work on the crane is performed. For this reason the closure body is mounted on a horizontal rail track for movement therealong. The outer profile of the closure body fits snugly in the inner profile of the wall opening or overlaps the wall opening completely.

6 Claims, 2 Drawing Figures

CLOSURE ARRANGEMENT FOR CLOSING A WALL OPENING IN A NUCLEAR FACILITY

FIELD OF THE INVENTION

The invention relates to a closure arrangement for closing an opening in a partition wall separating two mutually adjacent large-area cells of a nuclear facility in such manner that one of the cells is radiation shielded from the other one of the cells.

BACKGROUND OF THE INVENTION

A large-area cell of a nuclear facility constitutes a prohibited area when the same is utilized for the storage of containers holding medium-active waste. It is conventional to configure the next adjacent cell as an access or maintenance area wherein bridge cranes from the prohibited area can be serviced. An opening is provided in the partition wall separating the mutually adjacent cells to permit the bridge crane to pass therethrough. The wall opening must be closed during the time that maintenance work is performed on the cell crane in order to shield against radiation present in the prohibited area and to minimize the spread of contamination.

The required shielding against beta, gamma, and neutron rays leads to a situation where the closure body has a high weight dependent upon the size of the opening to be closed and upon the dose rate in the prohibited area. The closure body must be surely placed into its required position.

It has already been suggested to close the wall opening through which the rails of the cell crane pass with aid of bulkheads which are movable in the vertical direction. However, such bulkheads require heavy drives and the transfer of large forces by means of spindles, chains or the like. They are for this reason susceptible to failure and are costly.

It has been further suggested to provide doors that are movable in the transverse direction. These transversely movable doors have the advantage that they require no movement in the vertical direction. However, a significant disadvantage to such doors is that the rails of the cell crane have to be interrupted.

SUMMARY OF THE INVENTION

In view of the foregoing, it is an object of the invention to provide a radiation-shielding closure arrangement for closing the partition wall opening between two mutually adjacent large-area cells which is simple to build and can be operated without a malfunction.

The radiation-shielding closure arrangement of the invention closes an opening in a partition wall separating two large-area cells of a nuclear facility from each other. The closure arrangement includes: a closure body disposed in one of the large-area cells and rail means for supporting and movably guiding the closure body from a first position within the one large-area cell to a second position at the opening in the partition wall whereat the closure body closes the opening to radiation shield the other cell from the one cell. Sealing means seals the interface between the closure body and the peripheral region of the partition wall defining the wall opening whereby the other large-area cell is completely shielded against radiation from the one cell.

When the large-area cells are to be separated from each other by closing the wall opening, the closure body is moved horizontally on the rail means either into or onto the wall opening. The closure body either fits into the opening or covers the same. The radiation present in the one cell is shielded by an adequate configuration of the closure body.

According to another feature of the invention, the closure body can be movably mounted on the rails of the cell crane. With the closure body mounted in this manner, a separate set of rails or guides is not required. Furthermore, the closure of the wall opening is easier to achieve.

A further feature of the invention provides that the above-mentioned first position of the closure body is at the end of the rails and away from the partition wall wherein the opening is located. This is the position of the closure body for the normal operation of the nuclear facility. By mounting the closure body on the rails of the cell crane and in the cell wherein the radiation is present, the cell crane can be removed from the cell with the aid of the movable closure body in the event that the drive or the control of the cell crane should fail to operate. With the movement of the closure body along the rails, the cell crane is forcibly pushed ahead by the closure body and is moved into the adjacent cell which serves as a maintenance area when the closure body has closed off the prohibited area.

According to still another feature of the invention, the closure body is provided with a drive which is arranged at an accessible location in the cell serving as a maintenance area. The drive and braking forces are transferred by means of a cable or a chain.

BRIEF DESCRIPTION OF THE DRAWING

The invention will now be described with reference to the drawing wherein.

DESCRIPTION OF THE PREFERRED EMBODIMENTS OF THE INVENTION

Figure 1:
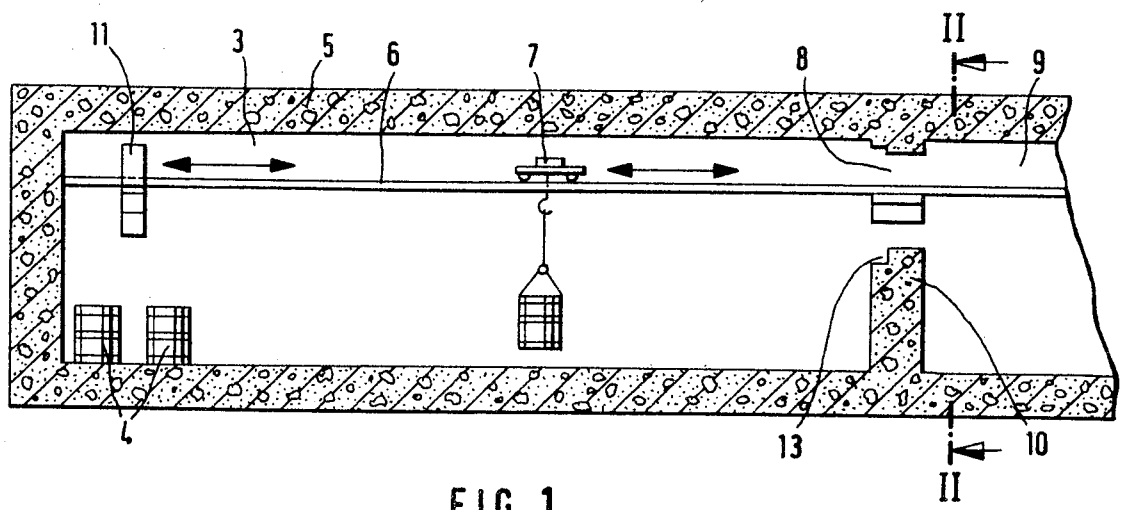
FIG. 1 is an elevation view, partially in section, of a nuclear facility having two mutually adjacent large-area cells and equipped with a radiation-shielding closure arrangement of the invention; and, FIG. 2 is an elevation view, also partially in section, taken along line II—II of FIG. 1 showing the partition wall opening which is to be closed and wherein the cell crane has been omitted.
Figure 2:
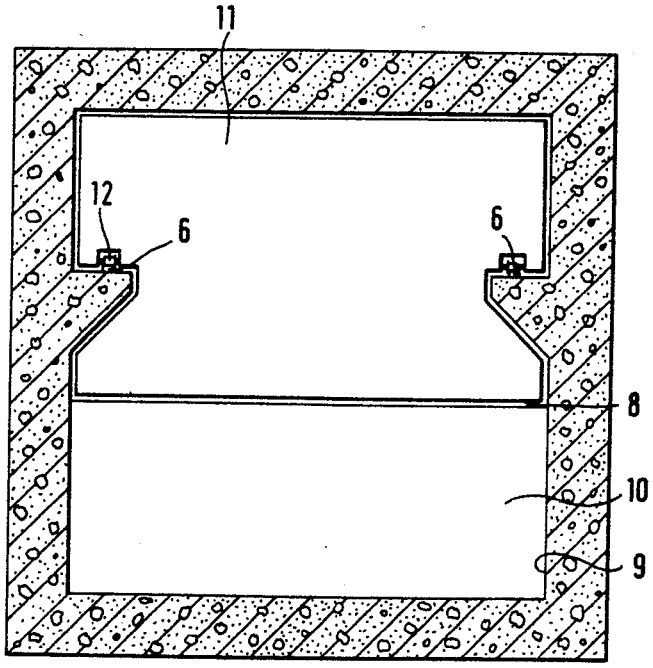

Referring to FIG. 1, the nuclear facility includes a large-area cell 3 wherein storage containers 4 containing medium-active waste are stored. Rails 6 of a cell crane 7 are arranged parallel to the containers and are mounted beneath the ceiling wall 5 of the large-area cell. The cell crane 7 brings the storage containers 4 to their storage positions. The rails 6 extend through an opening 8 into the adjacent large-area cell 9 which serves as an access or maintenance area. The cell 9 is separated from the cell 3 by the partition wall 10. The cell crane 7 can be serviced in the maintenance area 9 because the wall opening 8 is somewhat larger than the transverse profile of the cell crane 7 and the latter can be driven from the cell 3 into maintenance area 9.

A radiation-shielding closure body 11 is arranged in large-area cell 3 defining a prohibited area. The closure body 11 is mounted on the end of the rails 6 away from the wall opening 8. The closure body 11 is movable on the rails 6 in the horizontal plane by means of wheels 12. The outer profile of the closure body 11 is only slightly smaller than the inner profile of the wall opening 8. The closure body 11 can be moved into the wall so as to fit in the opening 8 thereby closing off the maintenance area 9 against radiation from the large-area cell 3. In this connection, it is most advantageous to provide a stepped recess 13 at the peripheral region of the wall 10 defining the opening 8 for receiving a correspondingly shaped profile of the closure body 11.

The closure body 11 is provided with its own drive which can be arranged in the maintenance area 9. The drive of the closure body 11 is preferably a cable drive or a chain drive.

If the cell crane 7 is to be serviced in the service or access area of the large-area cell 9, the closure body 11 is driven into the wall opening 8. The large-area cell 3 with its inventory of radioactive waste is closed off so as to be radiation shielded so that maintenance work in the access area 9 can be performed without being subjected to radiation.

In the event that the drive of the cell crane 7 fails, the crane can be moved out of the cell 3 and into the access area 9 by means of the closure body 11. In this situation, the closure body serves as a device for removing a non-operational crane from the prohibited area 3 in addition to serving as shield against radiation.

It is understood that the foregoing description is that of the preferred embodiments of the invention and that various changes and modifications may be made thereto without departing from the spirit and scope of the invention as defined in the appended claims.

What is claimed is:

1. A radiation-shielding closure arrangement for closing an opening in a partition wall separating two large-area cells of a nuclear facility equipped with a bridge crane mounted on rails passing from one of said cells wherein a radiation hazard is present through said opening to the other one of the large-area cells wherein maintenance work can be conducted on the bridge crane, the arrangement comprising:

a closure body disposed in said one large-area cell and movably mounted on said rails so as to be movable from a first position in said one cell to a second position at the opening in the partition wall whereat said closure body closes the opening to radiation shield said other cell from said one cell;

said closure body having a front wall surface facing towards said other cell and said bridge crane being disposed on said rails so as to be movable thereon between said front wall surface and said other cell thereby permitting said closure body to close said opening after said bridge crane has been moved into said other cell; and, sealing means for sealing the interface between said closure body and the peripheral region of said partition wall defining said opening to completely radiation shield said other large-area cell from said one large-area cell.

2. The radiation-shielding closure arrangement of claim 1, said sealing means including an inner profile formed in said peripheral region of said partition wall and dimensioned to correspond to the outer peripheral profile of said closure body.

3. The radiation-shielding closure arrangement of claim 1, said closure body being a wall-like structure having peripheral dimensions greater than the peripheral dimensions of said opening; said sealing means being defined by the portion of said closure body overlapping said opening and being in contact engagement with said peripheral region of said partition wall.

4. The radiation-shielding closure arrangement of claim 1, said closure body being at said first position during the normal operation of the nuclear facility, said first position being in said one cell at the end of said rails away from said opening.

5. The radiation-shielding closure arrangement of claim 1 comprising: drive means disposed outside said one large-area cell for moving said closure body between said first and second positions.

6. The radiation-shielding closure arrangement of claim 1, said sealing means including stepped recess means formed in said partition wall at said peripheral region thereof for receiving said closure body therein when the latter is in said second position.

* * * * *